US010494987B2

(12) United States Patent
Inoue et al.

(10) Patent No.: US 10,494,987 B2
(45) Date of Patent: Dec. 3, 2019

(54) COOLANT PASSAGE DEVICE FOR INTERNAL COMBUSTION ENGINE

(71) Applicants: NIPPON THERMOSTAT CO., LTD., Kiyose-shi, Tokyo (JP); TOYOTA JIDOSHA KABUSHIKI KAISHA, Kiyose-shi, Aichi (JP)

(72) Inventors: Fujio Inoue, Tokyo (JP); Daisuke Tsukamoto, Tokyo (JP); Hiroyasu Koyama, Toyota (JP)

(73) Assignees: NIPPON THERMOSTAT CO., LTD., Kiyose-shi (JP); TOYOTA JIDOSHA KABUSHIKI KAISHA, Toyota-shi (JP)

( * ) Notice: Subject to any disclaimer, the term of this patent is extended or adjusted under 35 U.S.C. 154(b) by 4 days.

(21) Appl. No.: 15/756,434

(22) PCT Filed: Aug. 17, 2016

(86) PCT No.: PCT/JP2016/073978
§ 371 (c)(1),
(2) Date: Feb. 28, 2018

(87) PCT Pub. No.: WO2017/043271
PCT Pub. Date: Mar. 16, 2017

(65) Prior Publication Data

US 2018/0252148 A1 Sep. 6, 2018

(30) Foreign Application Priority Data

Sep. 8, 2015 (JP) ..... 2015-176439

(51) Int. Cl.
*F01P 11/04* (2006.01)
*F01P 11/02* (2006.01)
*F01P 3/02* (2006.01)

(52) U.S. Cl.
CPC ..... *F01P 11/04* (2013.01); *F01P 11/028* (2013.01); *F01P 2003/025* (2013.01)

(58) Field of Classification Search
CPC ..... F01P 11/04; F01P 11/028; F01P 2060/08; F01P 2003/025
See application file for complete search history.

(56) References Cited

U.S. PATENT DOCUMENTS 5,666,911 A 9/1997 Gohl et al.
2006/0006641 A1* 1/2006 Hada ..... B01D 19/0042 285/136.1

(Continued)

FOREIGN PATENT DOCUMENTS

EP 1630016 A2 3/2006
EP 2034155 A1 3/2009

(Continued)

OTHER PUBLICATIONS

Extended (supplementary) European Search Report dated Dec. 19, 2018, issued in counterpart European Application No. 16844134.3. (6 pages).

(Continued)

*Primary Examiner* — Hung Q Nguyen
(74) *Attorney, Agent, or Firm* — Westerman, Hattori, Daniels & Adrian, LLP

(57) ABSTRACT

A coolant passage device 3 includes coolant intake pipes 11 and 12 that take in coolant from an engine, a delivery pipe 17 to a radiator communicating with the coolant intake pipes, and a delivery pipe 18 to the heater core branched from a central passage 16 connecting the coolant intake pipes with the delivery pipe to the radiator. A branch port 18*a* leading to the delivery pipe 18 to the heater core is opened in an upper portion in the central passage 16 in a state where the coolant passage device 3 is mounted to the engine, and the branch port 18*a* has a wall surface 21

(Continued)

surrounding the branch port and hanging down into the central passage 16. The wall surface 21 prevents bubbles contained in the coolant from entering the branch port 18*a*. And the coolant passage device consequently prevents coolant flow noise from occurring.

5 Claims, 9 Drawing Sheets

(56) References Cited

U.S. PATENT DOCUMENTS

| | | | | |
|---|---|---|---|---|
| 2010/0186925 | A1 | 7/2010 | Suzuki et al. | |
| 2011/0265739 | A1* | 11/2011 | Watanabe | F01P 11/04 123/41.01 |
| 2011/0284182 | A1* | 11/2011 | Inoue | F01P 11/04 165/51 |

FOREIGN PATENT DOCUMENTS

| | | | | |
|---|---|---|---|---|
| EP | 2187160 | A1 * | 5/2010 | B60H 1/02 |
| JP | 2009-85584 | A | 4/2009 | |
| JP | 2009-108812 | A | 5/2009 | |
| JP | 2010-196571 | A | 9/2010 | |
| JP | 2011-231722 | A | 11/2011 | |
| WO | WO-2010098068 | A1 * | 9/2010 | F01P 11/04 |

OTHER PUBLICATIONS

International Search Report dated Nov. 1, 2016, issued in Counterpart of International Application No. PCT/JP2016/073978 (2 pages).

* cited by examiner

COOLANT PASSAGE DEVICE FOR INTERNAL COMBUSTION ENGINE

TECHNICAL FIELD

The present invention relates to a coolant passage device to be used for a cooling device for cooling an internal combustion engine (hereinafter also referred to as an engine) by circulating coolant between a fluid passage formed in the internal combustion engine and a radiator.

BACKGROUND ART

This type of cooling device not only cools an internal combustion engine by circulating coolant between a fluid passage formed in the engine and a radiator, but also supplies the coolant to a heater circulation flow path including a heater core for heating. Further, in recent years, a cooling device has been devised that uses the coolant from the engine for an exhaust gas recirculation (EGR) cooler and a throttle body.

Thus, to circulate or supply the coolant to each part as described above, it becomes necessary to use branch pipes to individually connect pipes to each other. Thus, piping in an engine room becomes complicated, and as a result, this causes a problem to occur of lowering maintainability of the engine.

To simplify connection of the pipes, in the following prior art literature disclose that a coolant passage device is directly connected to a coolant discharge port of the engine, accommodates a water temperature sensor, for example, in the device, and in which device connection ports of the pipes are aggregated.

CITATION LIST

Patent Literature

Patent Literature 1: JP 2010-196571 A
Patent Literature 2: JP 2011-231722 A

The coolant passage device disclosed in the patent literature has been devised by the applicant of the present invention, and the coolant passage device can be provided in which the whole of the coolant passage device is molded using a synthetic resin, and weight saving and cost reduction can be achieved by utilizing the ease of resin molding. In addition, with the coolant passage device, stress applied to the device can be absorbed and dispersed by the entire device, and it is possible to effectively cope with stress due to thermal expansion of the engine and displacement of a fastening portion due to a difference in thermal expansion coefficient between the engine and the device.

SUMMARY OF INVENTION

Technical Problem

Air bubbles may enter the coolant in a coolant circulation path including the coolant passage device. However, the bubbles mixed in the coolant can be removed by a completely sealed reserve tank connected to a part of the coolant circulation path, for example. However, for example, during warm-up operation immediately after start of the engine, bubble escaping (air escaping) to the reserve tank is poor since the coolant does not circulate through a main cooling pipe passing through the radiator.

For this reason, for example, bubbles remaining at the uppermost portion of the engine tend to flow to a heater core for vehicle interior air conditioning (heating); in a case where coolant containing the bubbles flows through the heater core, abnormal noise (coolant-flowing noise) generated in the heater core leaks into a vehicle interior, and a problem arises where a passenger feels uncomfortable.

In the coolant passage device including a delivery pipe to the heater core, the air bubbles can be prevented from being sent to the heater core by opening a branch port leading to the delivery pipe to the heater core in a bottom portion of the coolant passage device. As a result, the abnormal noise (coolant flow noise) can be prevented from generating in the heater core.

In a case where the branch port to the heater core is provided in the bottom portion of the coolant passage device, however, the delivery pipe to the heater core is inevitably piped toward a lower side of the coolant passage device. In a crowded engine room, workability of maintenance is lowered such as connection or replacement of a hose connected to the heater core from the delivery pipe to the heater core. Thus, it is desirable that the connection ports of the pipes including the delivery pipe to the heater core are disposed facing upward from the coolant passage device, or facing to a lateral direction (horizontal state).

The present invention further improves the previously devised coolant passage device on the basis of the problems as described above and the viewpoint of maintenance. It is an object of the present invention to provide a coolant passage device that enables to effectively prevent bubbles from flowing to a heater core even if coolant containing the bubbles flows into the coolant passage device, and to prevent coolant-flowing noise from generating in the heater core.

Solution to Problem

The coolant passage device for an internal combustion engine according to the present invention is a coolant passage device that is used in a cooling device for an internal combustion engine forming a coolant circulation flow path between a fluid passage formed in the internal combustion engine and a radiator, and is provided between a coolant outlet portion of the internal combustion engine and a coolant inlet portion of the radiator, the coolant passage device including: a coolant intake pipe that takes in coolant from the internal combustion engine and communicates with a delivery pipe to the radiator; at least a delivery pipe to a heater core branched from a central passage connecting the coolant intake pipe with the delivery pipe to the radiator, wherein a branch port leading to the delivery pipe to the heater core is opened in an upper portion of the central passage in a state where the coolant passage device is mounted to the internal combustion engine, and the branch port has a wall surface surrounding the branch port and hanging down into the central passage, and the wall surface prevents bubbles contained in the coolant from entering the branch port.

In this case, in one preferred embodiment of the coolant passage device, the coolant intake pipe includes a pair of coolant intake pipes that takes in coolant respectively from a pair of engine heads in the internal combustion engine, and the branch port leading to the delivery pipe to the heater core is formed in the central passage formed between the pair of coolant intake pipes.

In another preferred embodiment of the coolant passage device, the branch port leading to the delivery pipe to the heater core is formed in a central passage between a single coolant intake pipe that takes in coolant from an engine head and the coolant delivery pipe to the radiator that communicates with the coolant intake pipe.

It is preferable that the coolant passage device is formed by joining a plurality of resin molded bodies individually molded, and that the coolant intake pipe, the delivery pipe to the radiator, and the delivery pipe to the heater core are integrally molded together in one resin molded body out of the plurality of resin molded bodies.

Advantageous Effects of Invention

In the coolant passage device for the internal combustion engine having the above-described structure, the branch port leading to the delivery pipe to the heater core is formed to be opened in the upper portion of the central passage connecting the coolant intake pipe with the delivery pipe to the radiator in a state where the coolant passage device is mounted to the internal combustion engine. The branch port has the wall surface hanging down into the central passage surrounding the branch port. Thus, even if bubbles enter the inside of the coolant passage device, the bubbles can be prevented from entering the heater core by an action of the wall surface surrounding the branch port leading to the delivery pipe to the heater core. As a result, the coolant passage device can be provided that prevents coolant flow noise from occurring in the heater core.

The branch port leading to the delivery pipe to the heater core is formed to be opened in the upper portion of the central passage of the coolant passage device, so that the delivery pipe to the heater core can be formed toward the upper portion of the coolant passage device, or toward the horizontal direction, inevitably. As a result, connection work and replacement work can be facilitated of various rubber hoses connected to the respective pipes aggregated in the coolant passage device, whereby a coolant passage device excellent in maintainability can be provided.

DESCRIPTION OF EMBODIMENTS

Figure 1:
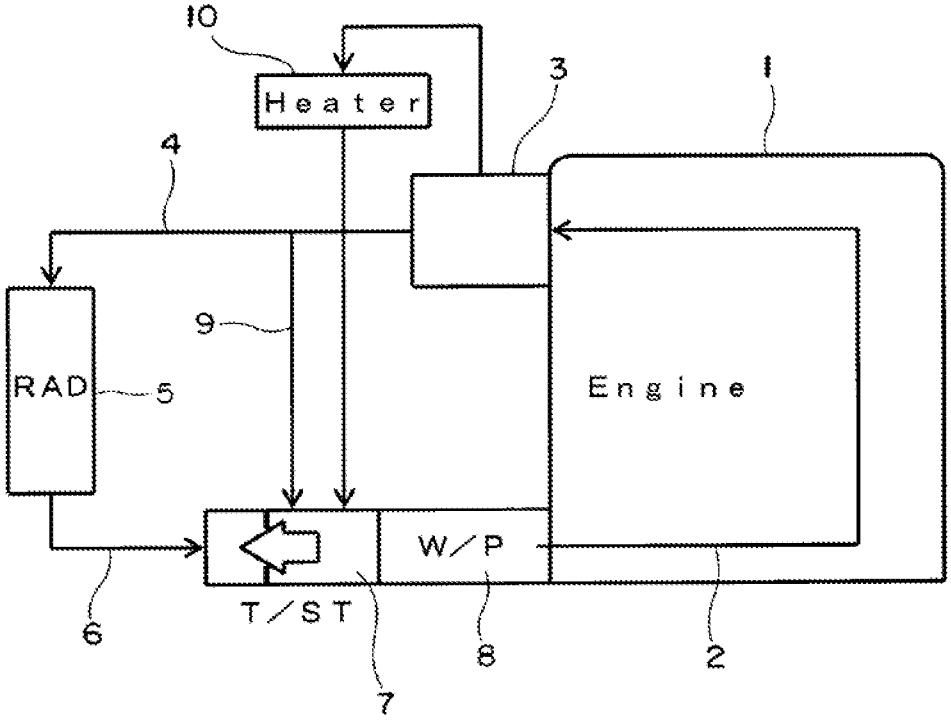
FIG. 1 is a schematic diagram illustrating an outline of a cooling device of an internal combustion engine.

A coolant passage device according to the present invention will be described on the basis of an embodiment illustrated in the drawings. First, FIG. 1 illustrates a basic structure of an engine cooling device using the coolant passage device according to the present invention. An internal combustion engine (hereinafter the engine) 1 is schematically illustrated, and the engine 1 includes a water jacket 2 that is a coolant passage. A coolant passage device 3 is mounted to an outlet portion for coolant from an engine head.

The coolant from the engine head enters a radiator 5 via a coolant feed flow path 4, and the coolant whose heat is released by the radiator 5 flows into a thermostat (T/ST) 7 via a return flow path 6. A housing for accommodating the thermostat 7 is disposed on the upstream side of a water pump (W/P) 8 for feeding coolant to the engine 1, and the coolant is circulated by driving of the water pump 8.

A bypass flow path 9 is formed from the coolant feed flow path 4 to the thermostat 7, and during warm-up operation of the engine 1, the coolant flows to the bypass flow path 9 by a function of the thermostat 7. Further, part of the coolant branched in the coolant passage device 3 enters a heater core 10 that functions as a heat exchanger for indoor heating, and returns to the housing of the thermostat 7 via the heater core 10.

FIGS. 2 to 8 each illustrate a first embodiment of the coolant passage device according to the present invention, and FIGS. 2 to 5 each illustrate an external structure of the coolant passage device 3. The coolant passage device 3 includes: a pair of coolant intake pipes 11 and 12 that respectively takes in coolant from left and right engine heads of a V-type engine, and is molded to face to the same direction; and flange-shaped fastening portions (flanges) 13 and 14 surrounding the openings of the pair of coolant intake pipes 11 and 12. The fastening portions 13 and 14 each include bolt insertion holes 15 for fastening the coolant passage device 3 to the right and left engine heads, at positions substantially corresponding to vertices of equilateral triangle being centered with the respective coolant intake pipes 11 and 12.

Figure 2:
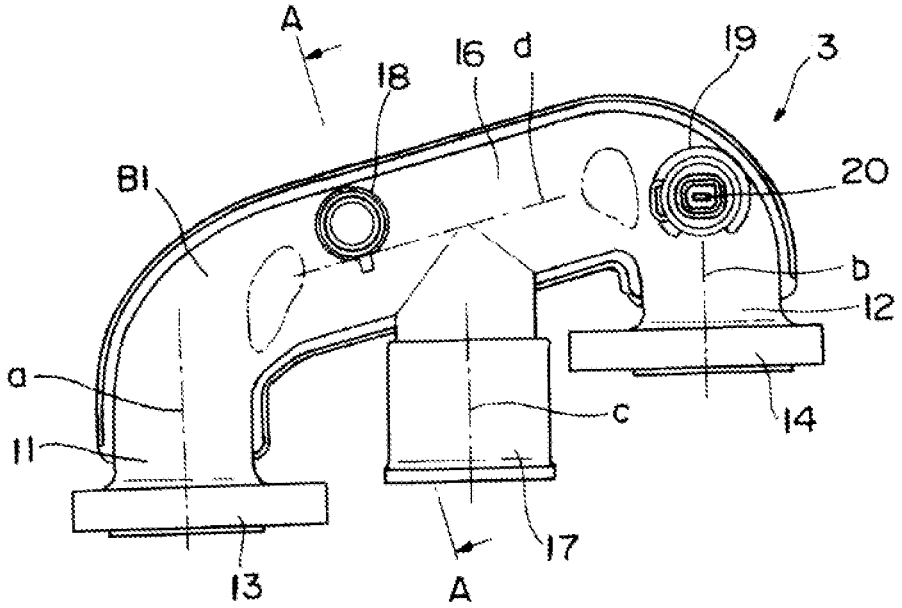
FIG. 2 is a top view illustrating a first embodiment of a coolant passage device according to the present invention.
Figure 3:
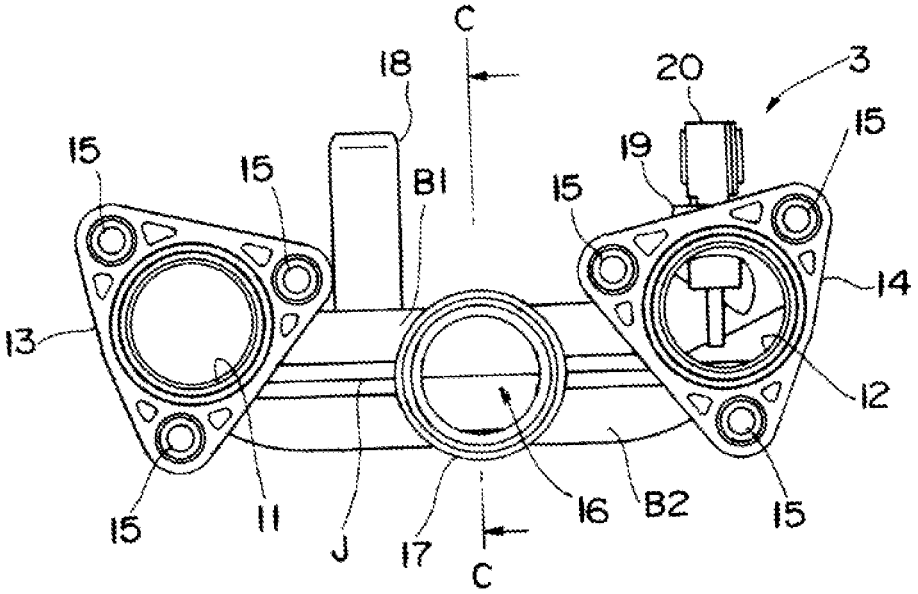
FIG. 3 is a front view of the first embodiment of the coolant passage device according to the present invention.
Figure 4:
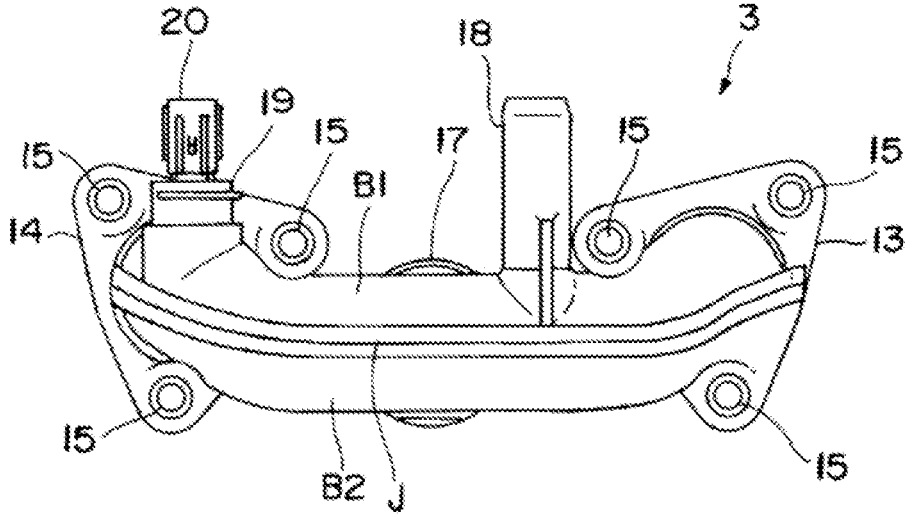
FIG. 4 is a rear view of the first embodiment of the coolant passage device according to the present invention.
Figure 5:
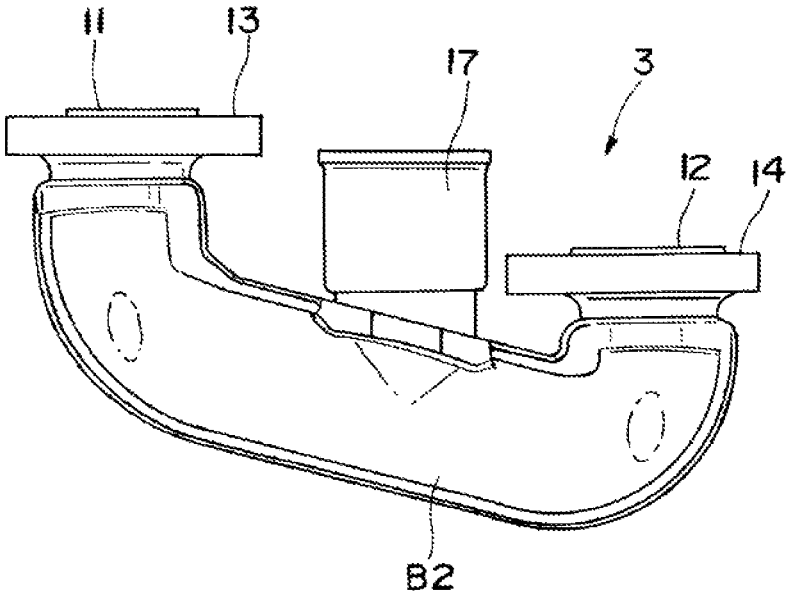
FIG. 5 is a bottom view of the first embodiment of the coolant passage device according to the present invention.
Figure 6:
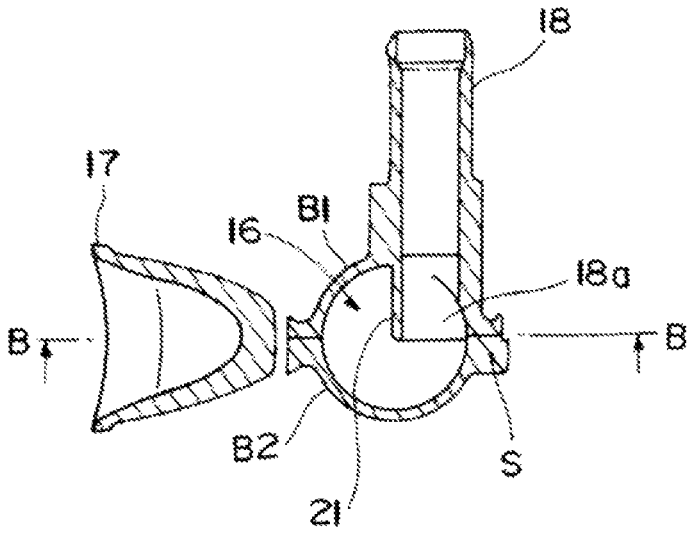
FIG. 6 is an enlarged cross-sectional view along the line A-A in FIG. 2, as viewed in the arrow direction.
Figure 7:
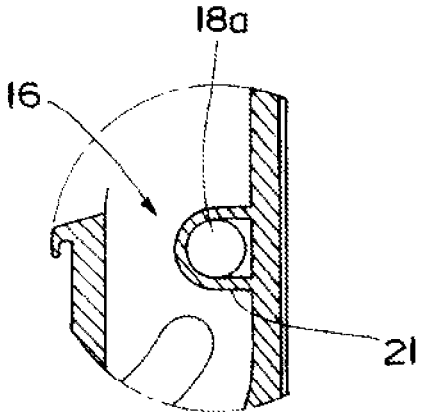
FIG. 7 is an enlarged cross-sectional view along the line B-B in FIG. 6, as viewed in the arrow direction.
Figure 8:
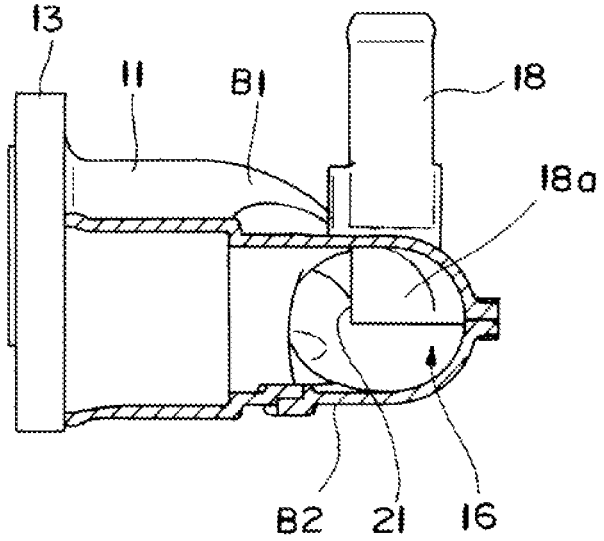
FIG. 8 is an enlarged cross-sectional view along the line C-C in FIG. 3, as viewed in the arrow direction.

As illustrated in FIGS. 6 to 8, a central passage 16 for collecting coolant is formed between the pair of coolant intake pipes 11 and 12. A delivery pipe 17 to a radiator is formed to communicate with the central passage 16 at a substantially central portion in the longitudinal direction of the central passage 16. As shown in FIGS. 2 and 5, the delivery pipe 17 to the radiator is formed to face to the same direction as the direction of the pair of coolant intake pipes 11 and 12.

That is, as shown in FIG. 2, which illustrates a plan view of the device 3 with the pair of coolant intake pipes 11 and 12 placed on the right and left of the device, respectively; lines a, b, c passing through the respective centers of the coolant intake pipes 11 and 12 and the delivery pipe 17 to the radiator are parallel to each other. A crossing angle between the line a passing through the center of the coolant intake pipe 11 and a line d passing through the center of the central passage 16 is an obtuse angle, and a crossing angle between the line b passing through the center of the other coolant intake pipe 12 and the line d passing through the center of the central passage 16 is an acute angle.

A delivery pipe 18 to a heater core is formed facing upward to communicate with the central passage 16 between the coolant intake pipe 11 in the coolant passage device 3 and the delivery pipe 17 to the radiator. As a result, the coolant discharged from the engine 1 is branched in the coolant passage device 3, and immediately supplied to the heater core 10.

A mounting pipe 19 for a water temperature sensor is formed facing upward at a portion where the other coolant intake pipe 12 in the coolant passage device 3 crosses the central passage 16. The water temperature sensor 20 is mounted fittedly in the axial direction to the mounting pipe 19, and a sensing area at a tip of the water temperature sensor is positioned in the coolant passage device 3. Water temperature information of the coolant obtained from the water temperature sensor 20 is sent to an engine control unit (ECU) (not shown).

FIGS. 6 to 8 are enlarged cross-sectional views illustrating a branching portion of the delivery pipe 18 to the heater core formed in the central passage 16 as viewed from different viewing angles, respectively. Relationships between FIGS. 6 to 8 and the other figures are as described in the Brief Description of the Drawings.

The delivery pipe 18 to the heater core is formed in the coolant passage device 3 to face upward in a state where the coolant passage device 3 is mounted to the engine 1. A branch port 18*a* leading from the central passage 16 of the coolant passage device 3 to the delivery pipe 18 to the heater core, is opened in an upper portion in the central passage 16.

In addition, the branch port 18*a* has a wall surface 21 surrounding the branch port 18*a* and hanging down into the central passage 16. As illustrated in FIGS. 6 and 8, the vertical dimension (protruding dimension) of the wall surface 21 hanging down into the central passage 16 reaches a center axis of the central passage 16 formed in a cylindrical shape.

The branch port 18*a* leading to the delivery pipe 18 to the heater core is formed at a position closer to the rear part from the axial center of the central passage 16. Thus, in FIG. 7 where the wall surface 21 surrounding the branch port 18*a* is viewed from below, a lower end portion of the wall surface 21 is formed in a U shape. That is, an arc-shaped inner circumferential surface forming the central passage 16 is positioned between U-shaped legs, so that the branch port 18*a* is surrounded by the substantially U-shaped wall surface 21 and the arc-shaped inner circumferential surface forming the central passage 16.

The main members, such as the pair of coolant intake pipes 11 and 12, the delivery pipe 17 to the radiator, the delivery pipe 18 to the heater core, and the water temperature sensor mounting pipe 19 described above, are integrally molded in one resin molded body as a first body B1. A resin molded body as a second body B2 is joined to the first body B1 at a bottom portion of the first body B1, to form the coolant passage device 3. That is, in this embodiment, the second body B2 functions as a kind of a lid member formed in a flat shape closing the central passage 16 at the bottom portion of the first body B1.

In molding the coolant passage device 3 including the first body B1 and the second body B2, a joining method can be used such as die slide injection (DSI) molding. That is, the first body B1 and the second body B2 are separately molded by primary injection, and as it is, dies are slid and the first body B1 and the second body B2 are joined; secondary injection is performed to a joint portion J of the bodies, whereby the coolant passage device 3 having a hollow structure can be molded. The first body B1 and the second body B2 can be joined together by well-known vibration welding instead of using the DSI molding.

With the coolant passage device 3, the branch port 18*a* leading to the delivery pipe 18 to the heater core is formed to be opened in the upper portion in the central passage 16, and the branch port 18*a* has the wall surface 21 surrounding the branch port and hanging down into the central passage 16. Thus, even if bubbles enter the inside of the coolant passage device 3, the bubbles can be prevented from entering the heater core 10 by an action of the wall surface 21 surrounding the branch port 18*a*. As a result, effects as described in the paragraph of advantageous effects of invention can be obtained, and for example, coolant flow noise can be prevented from occurring in the heater core 10.

FIGS. 9 to 14 illustrate a second embodiment of the coolant passage device according to the present invention, which is installed in a V type engine as in the first embodiment. In the second embodiment, parts that perform the same functions as those illustrated in FIGS. 2 to 8 already described are denoted by the same reference numerals, and a detailed description thereof will be omitted.

Figure 9:
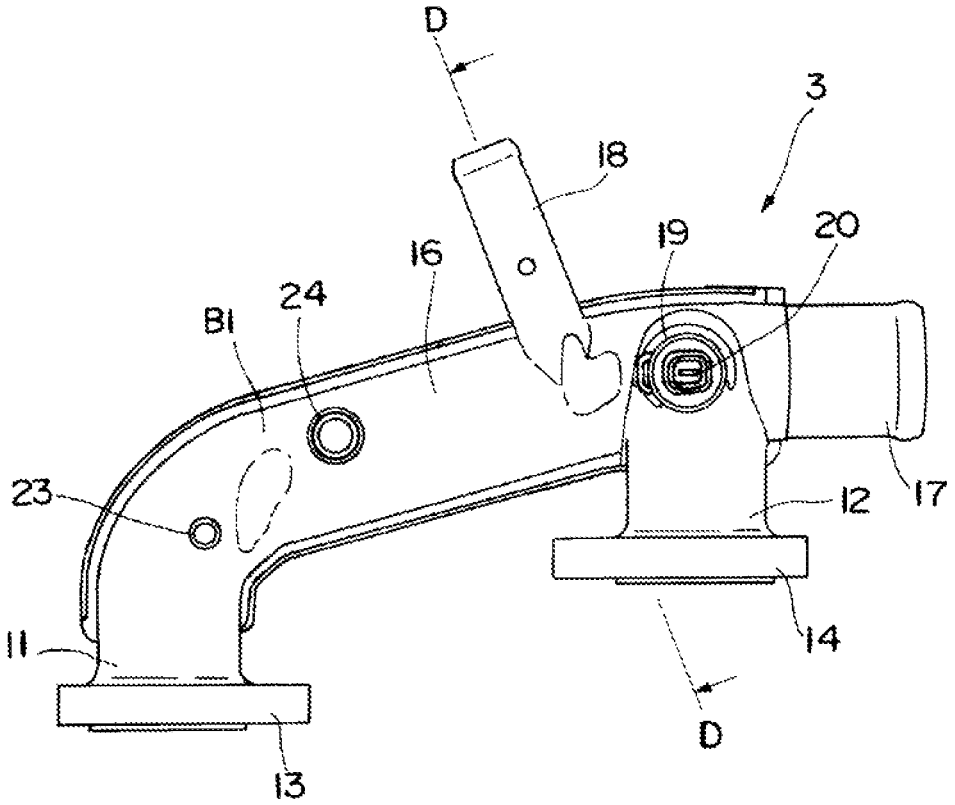
FIG. 9 is a top view illustrating a second embodiment of the coolant passage device according to the present invention.

In the second embodiment, a delivery pipe 17 to a radiator is formed in the extension line direction of a central passage 16 to communicate with one end side of the central passage 16, that is, a crossing portion of the central passage 16 and a coolant intake pipe 12 as illustrated in FIG. 9. In this embodiment, as illustrated in FIGS. 9 and 13, a delivery pipe 18 to a heater core is formed facing backward in the horizontal direction from the central passage 16 in the immediate vicinity of the coolant intake pipe 12.

Figure 10:
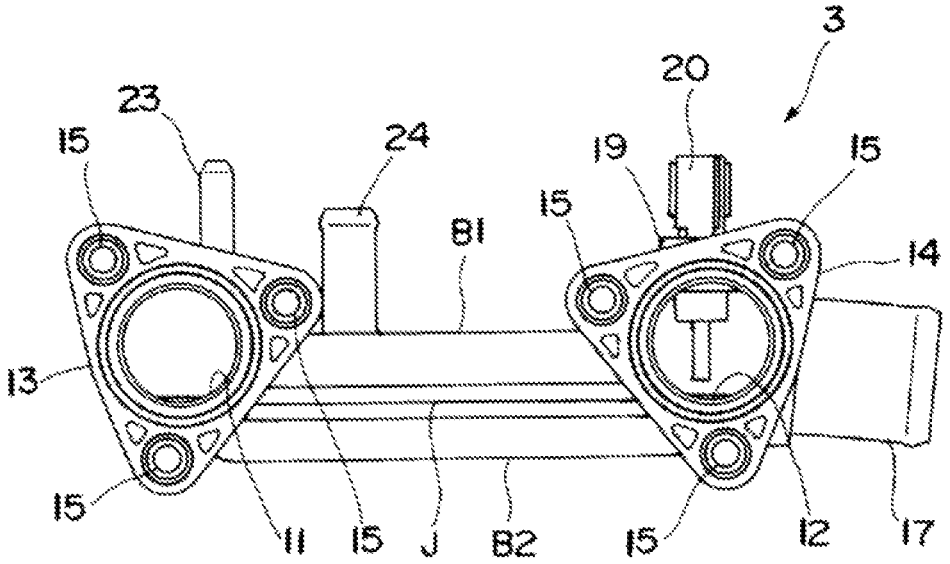
FIG. 10 is a front view of the second embodiment of the coolant passage device according to the present invention.
Figure 11:
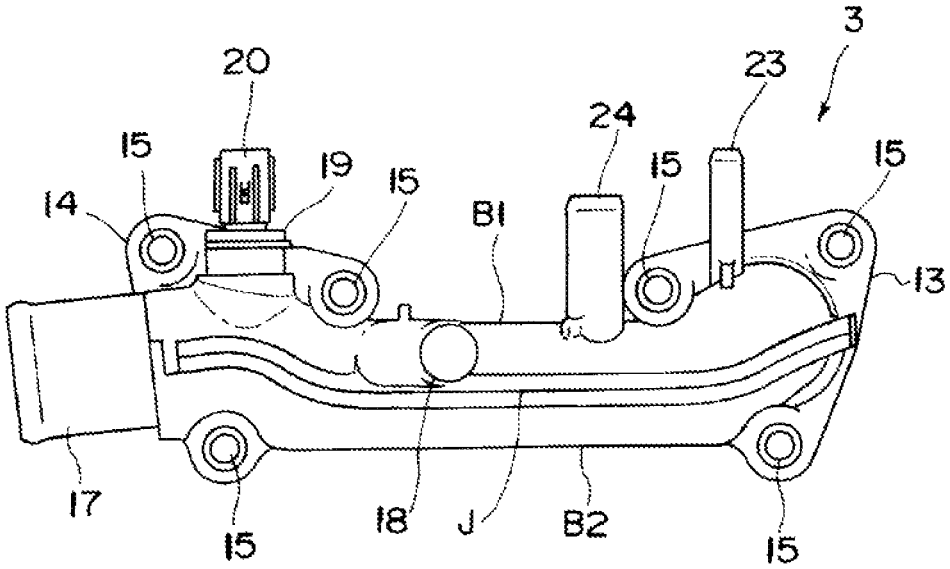
FIG. 11 is a rear view of the second embodiment of the coolant passage device according to the present invention.
Figure 12:
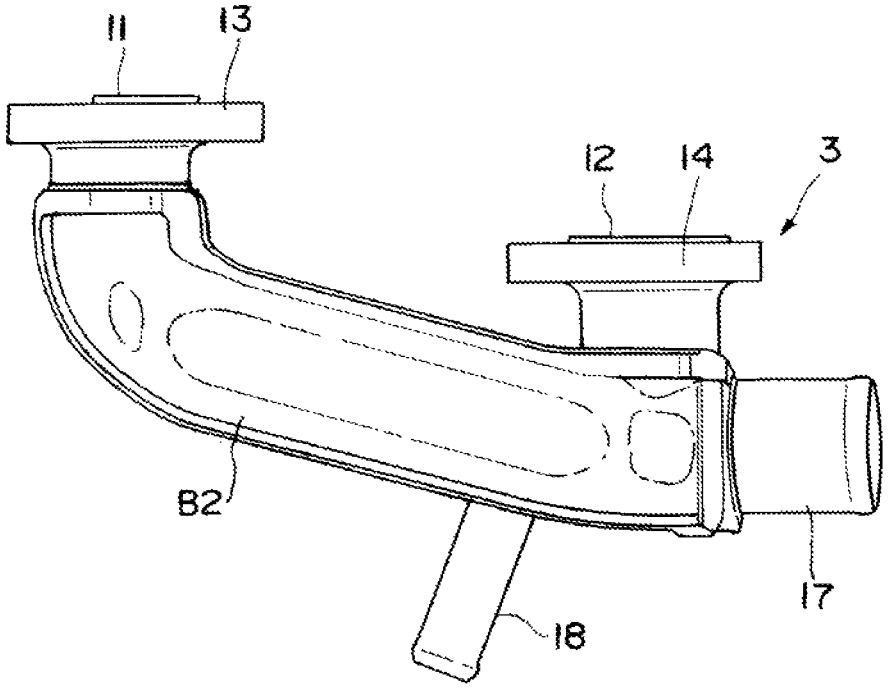
FIG. 12 is a bottom view of the second embodiment of the coolant passage device according to the present invention.

As shown in FIGS. 9 and 10, a delivery pipe 23 to a throttle body is formed facing upward at a crossing portion of a coolant intake pipe 11 and the central passage 16, and further, a delivery pipe 24 to an EGR cooler is formed facing upward between the delivery pipe 23 to the throttle body and the delivery pipe 18 to the heater core. The delivery pipe 23 to the throttle body and the delivery pipe 24 to the EGR cooler communicate with the central passage 16, and supply of the coolant is performed to be branched from a coolant passage device 3.

Figure 13:
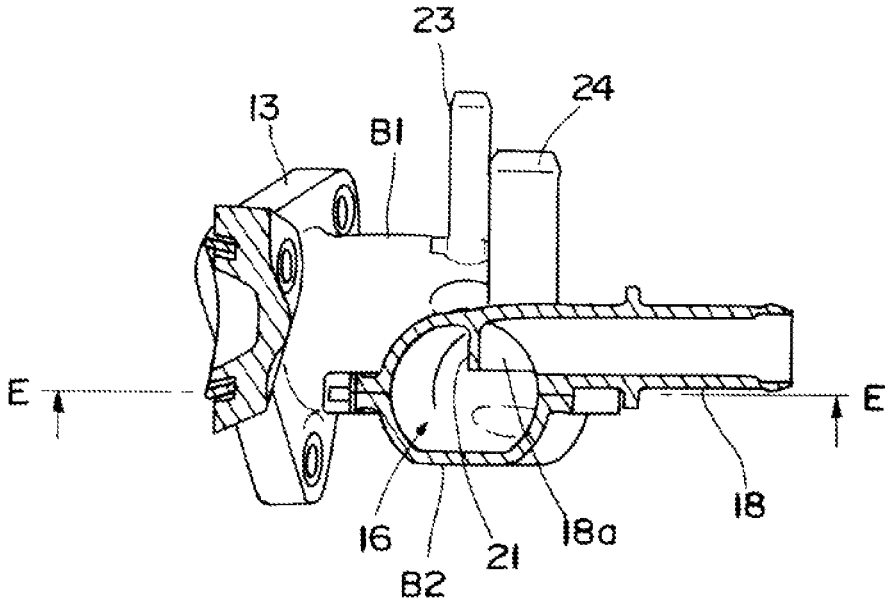
FIG. 13 is an enlarged cross-sectional view along the line D-D in FIG. 9, as viewed in the arrow direction.
Figure 14:
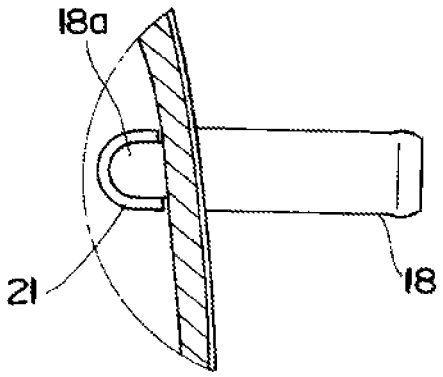
FIG. 14 is an enlarged cross-sectional view along the line E-E in FIG. 13, as viewed in the arrow direction.
Figure 15:
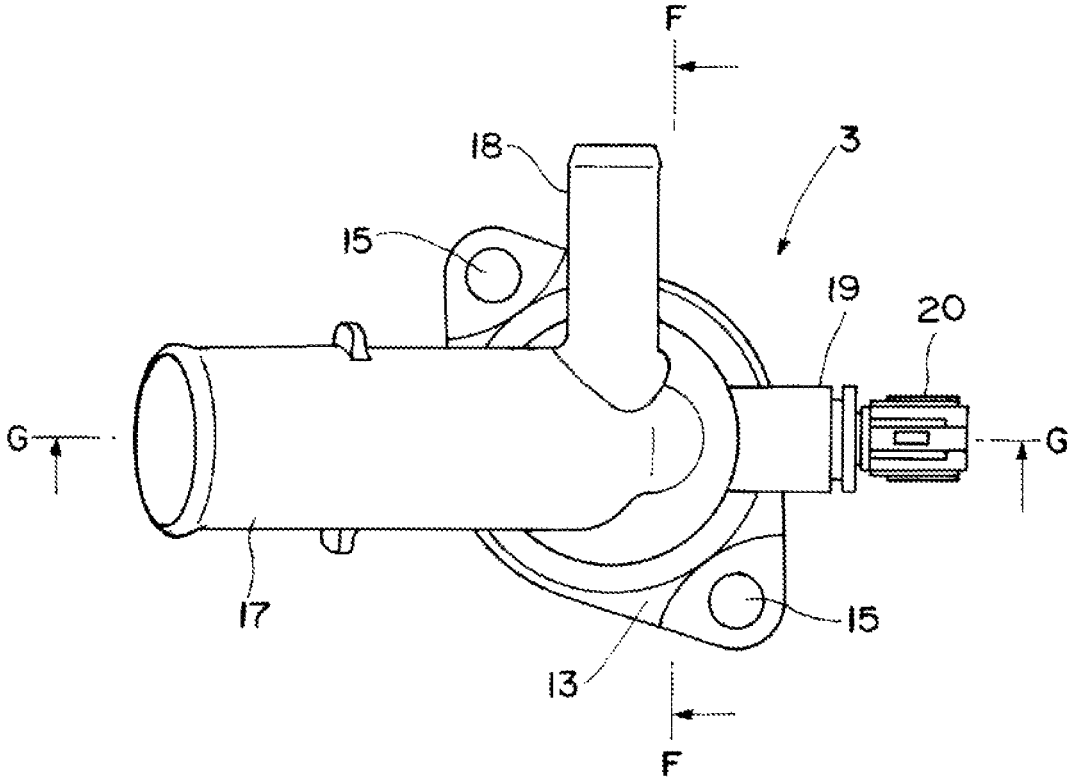
FIG. 15 is a rear view illustrating a third embodiment of the coolant passage device according to the present invention.

FIGS. 13 and 14 are enlarged cross-sectional views illustrating a branching portion of the delivery pipe 18 to the heater core formed in the central passage 16 as viewed from different viewing angles, respectively. As illustrated in FIGS. 13 and 14, a branch port 18*a* leading from the central passage 16 of the coolant passage device 3 to the delivery pipe 18 to the heater core is opened in an upper portion in the central passage 16. A wall surface 21 surrounding the branch port 18*a* and hanging down into the central passage 16 is formed at the branch port 18*a*.

That is, also in the second embodiment, the structure of the wall surface 21 formed to the branch port 18*a* leading to the delivery pipe 18 to the heater core is substantially the same as the structure in FIGS. 6 and 7 illustrated as the first embodiment. Thus, substantially the same effects can be obtained in that bubbles can be prevented from entering the heater core 10.

Also in the second embodiment, the main members, such as the pair of coolant intake pipes 11 and 12, the delivery pipe 17 to the radiator, the delivery pipe 18 to the heater core, a water temperature sensor mounting pipe 19, the delivery pipe 23 to the throttle body, and the delivery pipe 24 to the EGR cooler, are integrally molded in one resin molded body as a first body B1. A second body B2 is formed in a flat shape to close the central passage 16 at a bottom portion of the first body B1. Thus, the coolant passage device 3 having the hollow structure can be molded by utilizing the DSI molding.

The first embodiment (FIGS. 2 to 8) and the second embodiment (FIGS. 9 to 14) described above each illustrate the coolant passage device 3 mounted on a V-type engine; however, a third embodiment (FIGS. 15 to 18) to be described below illustrates an example of a coolant passage device 3 mounted in an in-line type engine.

The third embodiment includes: a single coolant intake pipe 11 that takes in coolant from an engine head; and a flange-shaped fastening portion (flange) 13 surrounding an opening of the coolant intake pipe 11. The flange-shaped fastening portion 13 includes a pair of bolt insertion holes 15 for fastening the coolant passage device 3 to the engine head of the in-line type engine, at both outer sides of the coolant intake pipe 11 as the center of the holes.

A delivery pipe 17 to a radiator is formed toward the horizontal direction via a central passage 16 bent with respect to the coolant intake pipe 11. That is, a bending angle of the central passage 16 connecting the coolant intake pipe 11 with the delivery pipe 17 to the radiator is a slightly obtuse angle as illustrated in FIG. 17.

A delivery pipe 18 to a heater core is formed facing upward to communicate with the central passage 16, in the bent central passage 16 between the coolant intake pipe 11 and the delivery pipe 17 to the radiator. As a result, the coolant discharged from an engine 1 is branched in the coolant passage device 3, and immediately supplied to a heater core 10.

A mounting pipe 19 for the water temperature sensor 20 is formed toward the horizontal direction on a side wall of the coolant intake pipe 11. That is, as illustrated in FIG. 17, the mounting pipe 19 for the water temperature sensor is formed toward the horizontal direction, on the opposite side with respect to the bending direction of the delivery pipe 17 to the radiator. The water temperature information of the coolant obtained from the water temperature sensor 20 is sent to an ECU (not shown) as described above.

Figure 16:
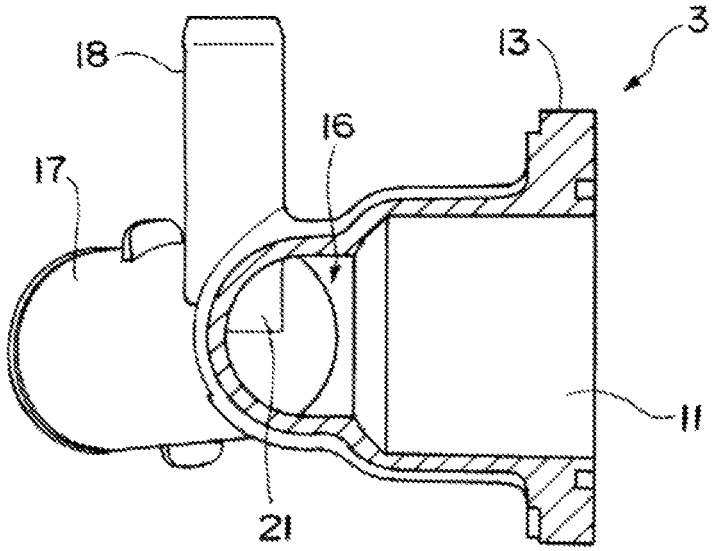
FIG. 16 is a cross-sectional view along the line F-F in FIG. 15, as viewed in the arrow direction.
Figure 17:
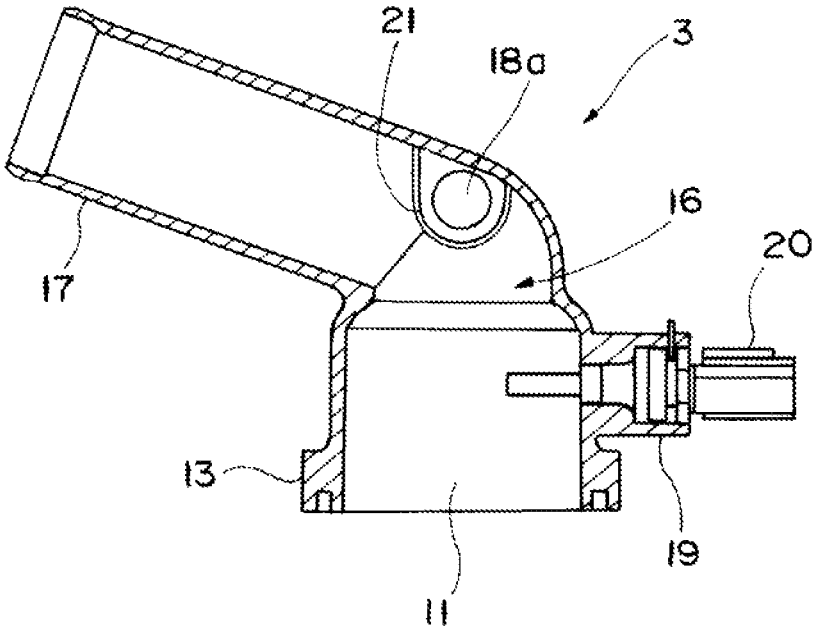
FIG. 17 is a cross-sectional view along the line G-G in FIG. 15, as viewed in the arrow direction.

FIGS. 16 and 17 illustrate a branching portion of the delivery pipe 18 to the heater core. The delivery pipe 18 to the heater core is integrally formed with the coolant passage device 3 so as to face upward in a state where the coolant passage device 3 is mounted to the engine 1. A branch port 18*a* leading from the central passage 16 of the coolant passage device 3 to the delivery pipe 18 to the heater core is opened in an upper portion in the central passage 16. In addition, the branch port 18*a* has a wall surface 21 surrounding the branch port 18*a* and hanging down into the central passage 16. As illustrated in FIG. 16, the vertical dimension (protruding dimension) of the wall surface 21 hanging down into the central passage 16 reaches a center axis portion in the central passage 16.

Also in the third embodiment, the structure of the wall surface 21 applied to the branch port 18*a* leading to the delivery pipe 18 to the heater core is substantially the same as the structure of the first embodiment (the structure illustrated in FIGS. 6 to 8). Thus, substantially the same effects can be obtained in that bubbles can be effectively prevented from entering the heater core 10, and coolant flow noise can be prevented from occurring in the heater core 10.

Although the first embodiment (FIGS. 2 to 8) and the second embodiment (FIGS. 9 to 14) described above both have a structure to be mounted on a V-type engine, it is possible to provide a coolant passage device that can be mounted on a horizontally opposed engine without changing its basic structure. Even when the coolant passage device is mounted on the horizontally opposed engine, the same effects can be obtained.

The invention claimed is:

1. A coolant passage device that is used in a cooling device for an internal combustion engine forming a coolant circulation flow path between a fluid passage formed in the internal combustion engine and a radiator, and is provided between a coolant outlet portion of the internal combustion engine and a coolant inlet portion of the radiator, the coolant passage device comprising:

a coolant intake pipe that takes in coolant from the internal combustion engine;

a delivery pipe to the radiator communicating with the coolant intake pipe; and at least a delivery pipe to a heater core branched from a central passage connecting the coolant intake pipe with the delivery pipe to the radiator, wherein a branch port leading to the delivery pipe to the heater core is opened in an upper portion in the central passage in a state where the coolant passage device is mounted to the internal combustion engine, the branch port has a wall surface surrounding the branch port and hanging down into the central passage, and the wall surface of the branch port forms an opening facing a direction that is orthogonal to a cross-section of the central passage, the cross-section extending along a longitudinal axis of the central passage at a location of the delivery pipe to the heater core, and towards the internal combustion engine.

2. The coolant passage device according to claim 1, wherein the coolant intake pipe includes a pair of coolant intake pipes that takes in coolant respectively from a pair of engine heads in the internal combustion engine, and the branch port leading to the delivery pipe to the heater core is formed in the central passage formed between the pair of coolant intake pipes.

3. The coolant passage device according to claim 1, wherein the branch port leading to the delivery pipe to the heater core is formed in a central passage between a single coolant intake pipe that takes in coolant from an engine head and the coolant delivery pipe to the radiator that communicates with the coolant intake pipe.

4. The coolant passage device according to claim 1, wherein the coolant passage device is formed by joining a plurality of resin molded bodies being individually molded, and the coolant intake pipe, the delivery pipe to the radiator, and the delivery pipe to the heater core are integrally molded together in one resin molded body out of the plurality of resin molded bodies.

5. The coolant passage device according to claim 2, wherein the coolant passage device is formed by joining a plurality of resin molded bodies being individually molded, and the coolant intake pipe, the delivery pipe to the radiator, and the delivery pipe to the heater core are integrally molded together in one resin molded body out of the plurality of resin molded bodies.

* * * * *